US008307594B2

(12) United States Patent
Schuster et al.

(10) Patent No.: US 8,307,594 B2
(45) Date of Patent: Nov. 13, 2012

(54) TOILET FLAPPER AND METHOD

(75) Inventors: Michael J. Schuster, Joliet, IL (US); Douglas C. Saunders, Plainfield, IL (US)

(73) Assignee: MJSI, Inc., Shorewood, IL (US)

( * ) Notice: Subject to any disclaimer, the term of this patent is extended or adjusted under 35 U.S.C. 154(b) by 407 days.

(21) Appl. No.: 12/435,716

(22) Filed: May 5, 2009

(65) Prior Publication Data

US 2009/0276947 A1 Nov. 12, 2009

Related U.S. Application Data

(60) Provisional application No. 61/050,652, filed on May 6, 2008.

(51) Int. Cl.
*E03D 1/35* (2006.01)

(52) U.S. Cl. ..... 52/394; 4/393; 4/395; 4/396

(58) Field of Classification Search ..... 4/393, 395, 4/396, 415, 324, 325, 402, 403
See application file for complete search history.

(56) References Cited

U.S. PATENT DOCUMENTS

| | | | | |
|---|---|---|---|---|
| 2,014,600 | A * | 9/1935 | Wayne | 4/403 |
| 2,328,701 | A * | 9/1943 | Woodrum | 4/398 |
| 2,475,681 | A * | 7/1949 | Stentz | 4/397 |
| 2,504,555 | A * | 4/1950 | Loether | 4/397 |
| 2,763,872 | A * | 9/1956 | Nelson | 4/393 |
| 2,949,613 | A * | 8/1960 | Svabek, Jr. et al. | 4/392 |
| 4,364,129 | A * | 12/1982 | Schonger | 4/324 |
| 5,129,110 | A * | 7/1992 | Richter | 4/324 |
| 5,153,948 | A * | 10/1992 | Smith et al. | 4/415 |
| 5,966,749 | A * | 10/1999 | Goesling et al. | 4/392 |
| 6,615,415 | B1 * | 9/2003 | Lai | 4/392 |
| 6,742,194 | B2 * | 6/2004 | Shim | 4/325 |
| 6,829,787 | B1 * | 12/2004 | Pipenburg | 4/393 |
| 7,891,028 | B1 * | 2/2011 | Camargo et al. | 4/393 |
| 8,087,106 | B1 * | 1/2012 | Mitchell | 4/393 |
| 2003/0200601 | A1 * | 10/2003 | Little | 4/393 |
| 2004/0172747 | A1 * | 9/2004 | Sirizzotti | 4/392 |
| 2007/0101486 | A1 * | 5/2007 | Torres et al. | 4/392 |
| 2010/0077545 | A1 * | 4/2010 | Sakemi et al. | 4/392 |

* cited by examiner

*Primary Examiner* — Jeanette Chapman
(74) *Attorney, Agent, or Firm* — Thomas Horstemeyer, LLP

(57) ABSTRACT

Disclosed are a toilet flapper and associated methods. In one representative embodiment, a flapper is provided having an upper side and a sealing side, the sealing side including a sealing surface. A dome protrudes from the sealing side at a middle of the sealing surface. Also, an opening of the dome is positioned in the upper side of the flapper. A float is employed with the flapper.

17 Claims, 10 Drawing Sheets

FIG. 9A
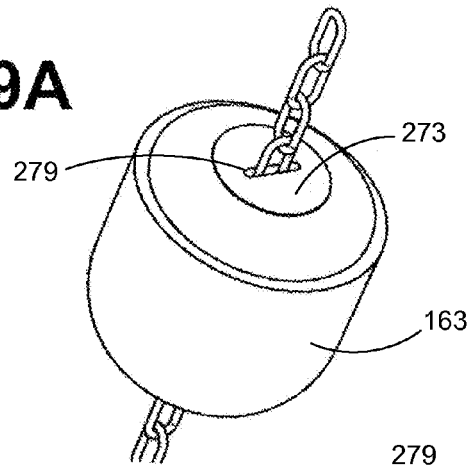
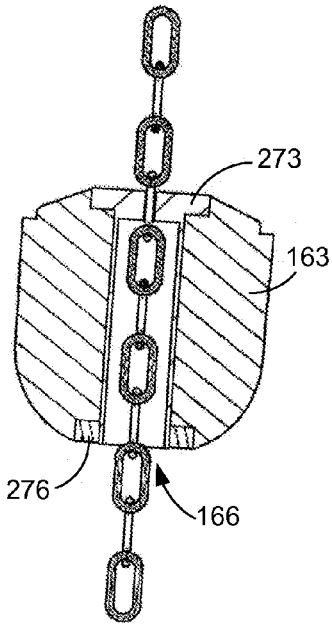
FIG. 9B
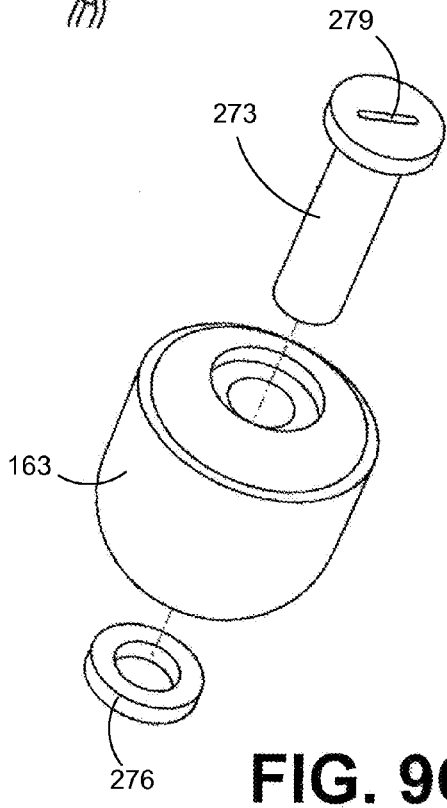
FIG. 9C

TOILET FLAPPER AND METHOD

CROSS REFERENCE TO RELATED APPLICATION

This application claims priority to co-pending U.S. Provisional Patent Application entitled "TOILET FLAPPER AND METHOD" filed under Ser. No. 61/050,652 on May 6, 2008, which is incorporated herein by reference in its entirety.

BACKGROUND

Toilets use a lot of water at a time when water is becoming scarce. As a consequence, low flow toilets and the like have been designed to use less water. However, even considering low flow designs, toilets still use much of the water consumed by people resulting in an adverse effect on the environment.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

FIGS. 9A, 9B, and 9C are drawings of another embodiment of the float that may be employed with the toilet flapper of FIG. 1 or the toilet flapper assembly of FIG. 5 according to an embodiment of the present disclosure.

DETAILED DESCRIPTION

Figure 1:
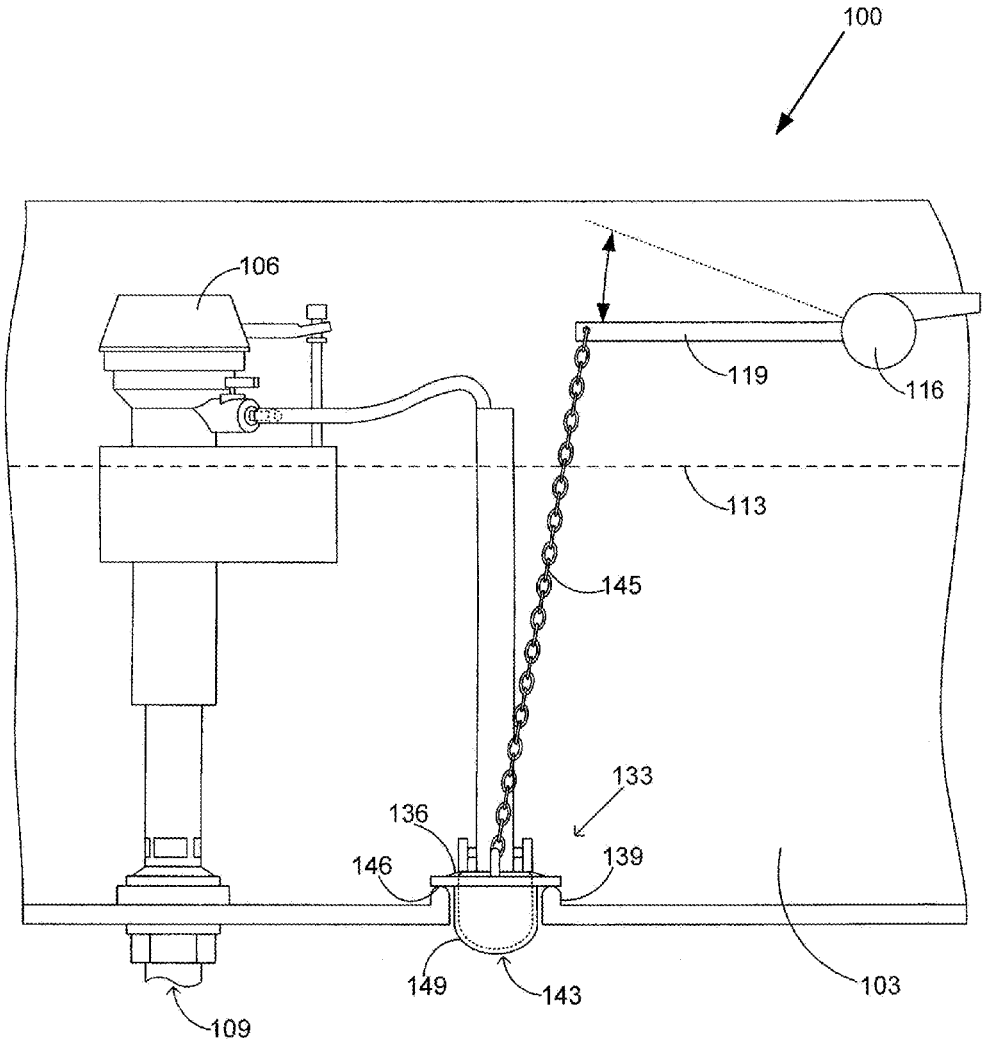
FIG. 1 is a drawing of a toilet tank assembly according to an embodiment of the present disclosure.

With reference to FIG. 1, shown is a toilet tank assembly 100 that comprises a toilet tank 103 with a fill valve 106. The fill valve 106 controls the filling of the toilet tank 103 by allowing water to enter the toilet tank 103 through an inlet 109 during the flush cycle of a toilet that employs the toilet tank assembly 100. At the end of a given flush, the toilet tank 103 is filled up to the water level 113 as shown. The toilet tank assembly 100 further includes a flush handle 116 that protrudes from the outside of the toilet tank 103. The flush handle 116 is coupled to a flush lever 119. The toilet tank assembly 100 further includes a flush valve 133 that comprises a flapper 136 and a seat 139 of a flush orifice 143 in the toilet tank 103. A tether 145 attaches the flapper 136 to the flush lever 119. The flapper 136 may be constructed of rubber, plastic, or other suitable material. The tether 145 may comprise, for example, a chain, cord, string, or other type of tether 145 as can be appreciated.

The flapper 136 is positioned in the seat 139 of the flush orifice 143 of the toilet tank 103 so as to prevent water within the tank 103 from draining into the toilet bowl until a flush is implemented. The flapper 136 seals the flush orifice 143 by virtue of a sealing surface 146 that contacts the seat 139. An inverted dome 149 protrudes from a sealing side of the flapper 136 and through the flush orifice 146 when the flush valve 133 is in a closed state as shown. The dome 149 thus protrudes from a sealing side of the flapper 136 in the middle of the sealing surface 146 and into the flush orifice 143. Thus, the flush orifice 143 is sealed by virtue of the sealing surface 146 and the dome 149 of the flapper 136. To this end, water enters into the dome 149 through an opening at the upper end of the dome 149 located on the upper side of the flapper 136. Stated another way, the opening is on a side that is opposite the side of the sealing surface 146 of the flapper 136. Due to this configuration, the flapper 136 itself may be made of a material so as not to be buoyant when submerged in water depending upon the material used. As contemplated herein, when the flapper 136 lacks buoyancy, it will fall to the closed position, thereby preventing water from draining through the flush orifice 143. According to various embodiments, a float is employed with the flapper 136 to provide buoyancy so that the flapper 136 remains tilted in an open state as desired during a flush cycle as will be described.

Figure 2:
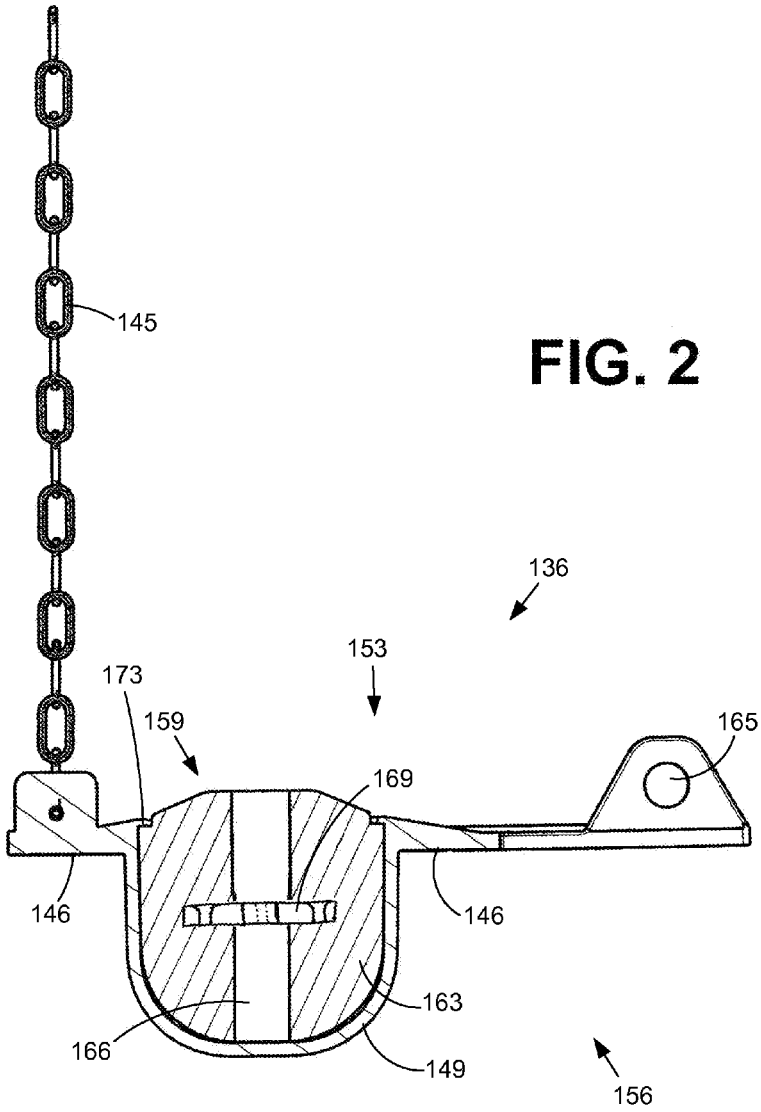
FIG. 2 is a cutaway view of a toilet flapper employed in the toilet tank assembly of FIG. 1 according to an embodiment of the present disclosure.

Referring next to FIG. 2, shown is a cutaway view of the flapper 136 and the tether 145 according to various embodiments. As shown, the flapper 136 includes an upper side 153 and a sealing side 156. Disposed in the sealing side 156 of the flapper 136 is the sealing surface 146. The dome 149 protrudes from the sealing side 156. According to various embodiments, the dome 149 is a solid structure without any holes such that it will retain liquid if held in an upright manner. To this extent, the dome 149 includes an opening 159 that is positioned in the upper side 153 of the flapper 136.

According to one embodiment, a float 163 is disposed within the dome 149 of the flapper 136. To this end, the float 163 has a shape that conforms with a shape of the dome 149. The float 163 may be constructed, for example, from Styrofoam, or other floating material. A passageway 166 is formed through the float 163. An insert 169 is disposed within the float 163. According to one embodiment, the insert 169 may be molded into the float 163. The insert 169 presents a restriction in the passageway 166 that is configured to crimp the tether 145 that is coupled to the flapper 136 as will be described. The flapper 136 further comprises a retaining lip 173 that is disposed around the periphery of the opening 159, where the retaining lip defines the opening 159.

According to one embodiment, the float 163 is removable from the dome 149 of the flapper 136 by pressing against the bottom portion of the dome 149 to push the float 163 out of the flapper 136 through the opening 159. To this end, the opening 159 may stretch to accommodate removal of the float 163. When the float 163 is left in the dome 149, the retaining lip 173 ensures that the float 163 can not work its way out of the dome 149. When the float 163 is disposed within the dome 149 of the flapper 136, then the flapper 136 can operate to drain the majority of the tank during the flush cycle.

However, it is pointed out that the dome 149 is uniform such that there are no holes in the dome 149 so as to prevent water from draining out of the toilet tank 103 (FIG. 1) through the flapper 136 while in the closed position. To this end, both the sealing surface 146 and the dome 149 form a seal that covers the flush orifice 143 to prevent water from leaking out of the toilet tank 103 after the toilet tank has been filled after a flush.

The retaining lip 173 retains the float 163 within the dome 149 by virtue of the fact that the diameter of the opening 159 defined by the retaining lip 173 is less than a maximum dimension, such as a diameter, of the float 163 and/or dome 149 where the shape of the float 163 conforms with the shape of the dome 149. By virtue of the fact that the float 163 is larger than the opening 159, the retaining lip 173 restricts the float 163 from exiting the dome 149 unless it is forced through the opening 159 by pressing at the bottom of the dome 149 as described above.

The flapper 136 further comprises pivot holes 165 at a pivot end of the flapper 136 that are coupled to pins in the toilet assembly that allow the flapper 136 to pivot such that the flush valve 133 can be transitioned from a closed state to an open state and vice versa. Alternatively, the flapper 136 can be pivotally attached to some other structure such as an overflow tube or other structure in the toilet.

Due to the fact that the float 163 is retained in the flapper 136 according to one embodiment, when the flush handle 116 is pulled down, thereby pulling the flapper up off of the seat 139 of the flush orifice 143, water then drains from the toilet tank 103 into a toilet bowl as can be appreciated. During this time, the float 163 will ensure that the flapper is maintained in an open or upward position, where the float 163 provides buoyancy to float the flapper 136 in an upward angle as can be appreciated. When the water level 113 within the toilet tank 103 drops to the bottom, the flapper 136 will fall down onto the seat 139 of the toilet tank 103 and the toilet tank 103 will begin refilling by virtue of the operation of the fill valve 106 (FIG. 1).

Figure 3:
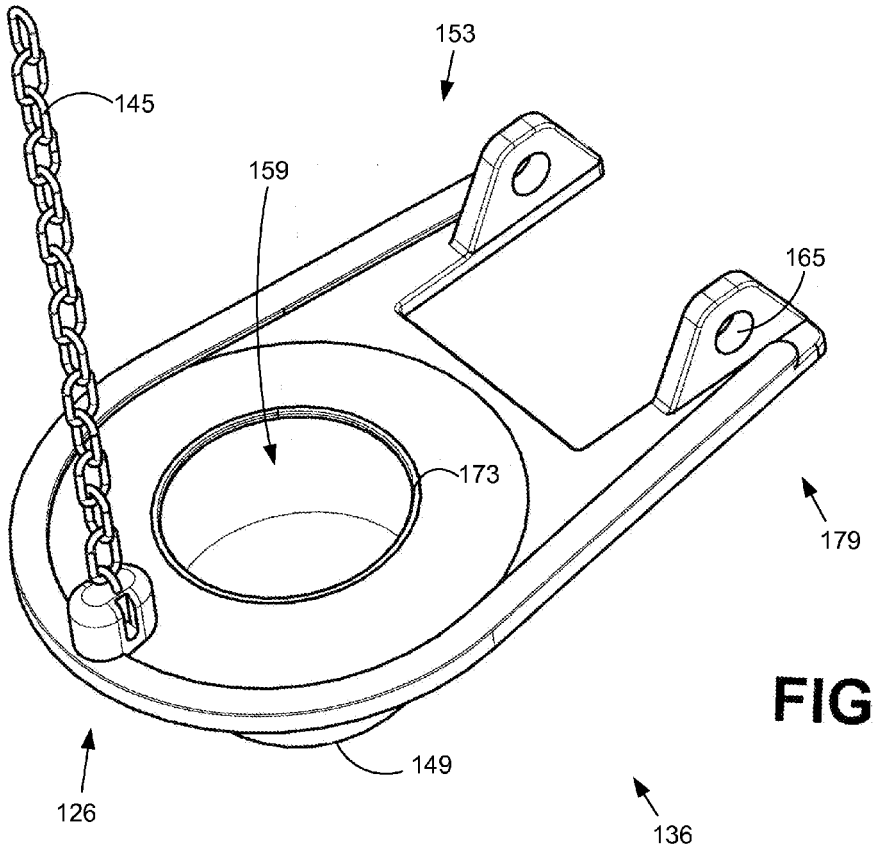
FIG. 3 is a perspective view of the toilet flapper of FIG. 2 according to an embodiment of the present disclosure.

With reference to FIG. 3, shown is a perspective view of the flapper 136 that specifically shows the upper side 153 in which the float 163 has been removed. The opening 159 defined by the retaining lip 173 is shown with the cavity created by the dome 149 into which the float 163 may be inserted. The tether 145 is attached to the tethered connection positioned at a sealing end 176 of the flapper 136. Also, the holes 165 to engage the pins in the toilet tank 103 (FIG. 1) are clearly shown at a pivot end 179 of the flapper 136.

By virtue of the opening 159 at the upper side 153 of the flapper 136, when the flapper 136 is in use in a toilet tank 103 (FIG. 1) sealing the flush orifice in a full toilet tank 103, water enters the dome 149. As such, the concave portion of the dome 149 serves to seal the flush orifice 143 as well as the sealing surface 146 as described above with reference to FIG. 1.

Figure 4:
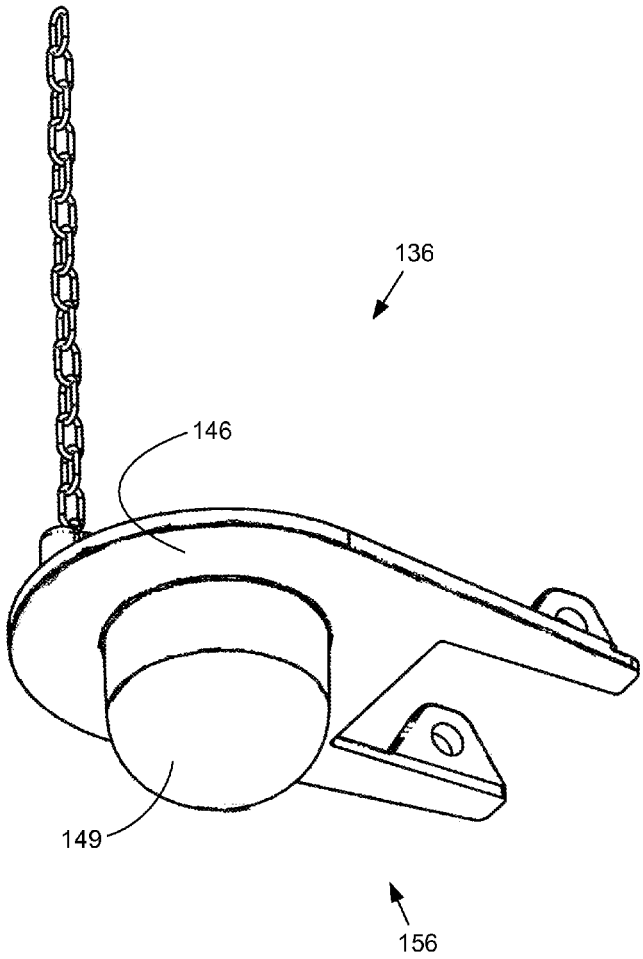
FIG. 4 is a second perspective view of the toilet flapper of FIG. 2 according to an embodiment of the present disclosure.

Referring next to FIG. 4, shown is another perspective view of the flapper 136 that particularly illustrates the sealing side 156 of the flapper 136. Further, the dome 149 is clearly illustrated without any holes so as to properly plug the flush orifice 143 of the toilet tank 103 to allow the toilet tank 103 to fill during a flush cycle as can be appreciated.

Figure 5:
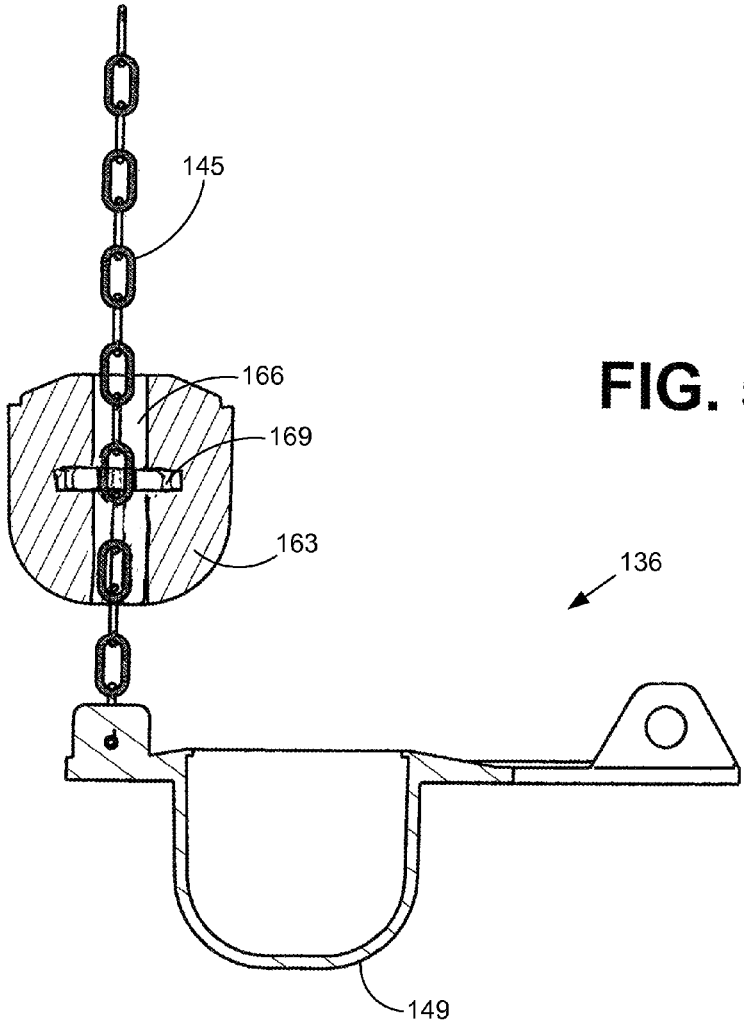
FIG. 5 is a cutaway view of the toilet flapper assembly according to another embodiment of the present disclosure.

Referring next to FIG. 5, shown is another view of the flapper 136 with the float 163 removed and the tether 145 extended through the passageway 166 of the float 163 according to various embodiments. The float 163 is removed from the dome 149 of the flapper 136. As mentioned above, the float 163 provides the buoyancy for the flapper 136 when the float 163 is inserted into the dome 149. When the float 163 is taken out of the dome 149, the tether 145 is threaded through the passageway 166 and the insert 169 of the float 163. The insert 169 presents a restriction in the passageway 166 that crimps the tether 145 to hold the float 163 in a predefined position along the tether 145. By applying appropriate force, against the float 163 relative to the tether 145, or vice versa, to overcome the hold of the restriction crimping the tether 145, the position of the float 163 along the tether 145 may be adjusted.

In this regard, the float 163 provides buoyancy for the flapper 136 so as to ensure the flapper 136 is held in an open position at the beginning of the flush cycle. However, when the water level 113 (FIG. 1) of the toilet tank 103 (FIG. 1) drops to the height of the float 163 on the tether 145, then the float 163 will drop with the water level, thereby causing the flapper 136 to fall and close the flush orifice 143.

Thus, in this configuration, the position allows the flapper 136 to "close early" in a flush cycle, thereby preventing the entire contents of the toilet tank 103 from draining during a given flush. Advantageously, the float 163 may be adjusted at any position along the tether 145 to ensure that an optimal amount of water is drained into a toilet bowl through the flush orifice 143 during a given flush in order to successfully pull a siphon, jet, or wash the water down through the toilet bowl, thereby flushing the contents of the toilet bowl down the drain. At the same time, easy adjustment of the position of the float 163 on the tether 145 facilitates adjustments to maximize efficiency of the toilet to save a maximum of water per flush. Also, advantageously, the position of the float 163 may be adjusted merely by applying force to the float 163 relative to the tether 145, or vice versa, to move the float 163 up or down with respect to the tether 145. This adjusts the point during a flush at which the flapper 136 begins to fall with the water level to drop the flapper 136 and close the flush valve 133 (FIG. 1) before the toilet tank 103 is completely drained during a toilet flush cycle.

Figure 6:
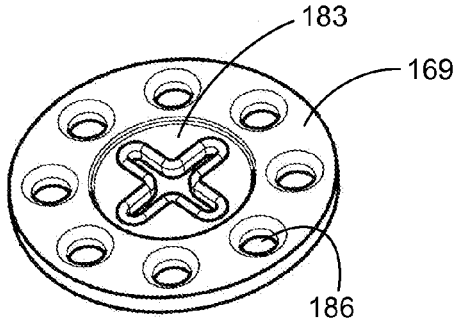
FIG. 6 is a perspective view of an insert in a float of the toilet flapper assembly of FIG. 5 according to an embodiment of the present disclosure.

Referring then to FIG. 6, shown is one example of the insert 169 according to various embodiments. The insert 169 includes a crimping orifice 183 that essentially crimps the tether 145 with enough holding force to maintain the position of the float 163 on the tether 145 when the float 163 is submerged in water. To this end, the upward force due to the buoyancy of the float 163 when submerged in water is overcome by the crimping force of the insert 169 in holding onto the tether 145 such that the float 163 remains in a stationary position along the tether 145. It is understood that many other configurations of an insert 169 may be employed to crimp the tether 145 including those described hereafter. The insert 169 further includes holes 186 through which the float material 163 can "grab" the insert 169 for more stable positioning within the float 163.

According to one embodiment, the insert 169 may be made of any number of different materials such as, for example, rubber, plastic, or other materials. The rigidity of the materials used is specified so as to provide for effective crimping of the tether 145, while at the same time facilitating relatively easy movement of the float 163 with respect to the tether 145 with the exertion of a modest amount of force by hand to move the float 163 with respect to the tether 145.

Figure 7A:
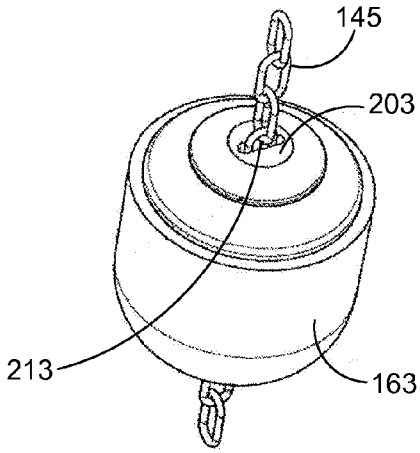
FIGS. 7A and 7B are drawings of one embodiment of the float that may be employed with the toilet flapper of FIG. 1 or the toilet flapper assembly of FIG. 5 according to an embodiment of the present disclosure.
Figure 7B:
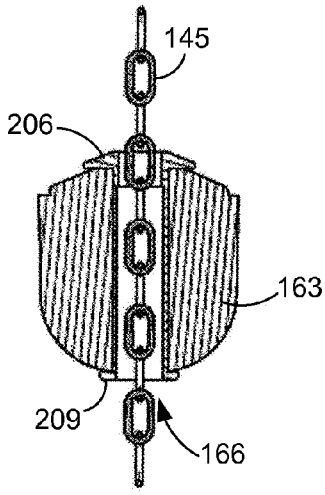

Referring next to FIGS. 7A and 7B, shown is an alternative version of the float 163 with an insert 203 according to various embodiments that facilitates the crimping of the tether 145 as described above. The insert 203 is inserted into the passageway 166 of the float 163. The insert 203 includes an upper lip 206 and a lower lip 209. The upper and lower lips 206 and 209 hold the insert into the passageway 166 by resisting longitudinal movement of the insert 203 relative to the passageway 166. The insert 203 also includes a crimping slot 213 that presents a restriction to crimp the tether 145 to hold the float 163 in a predefined position along the tether 145.

Figure 8A:
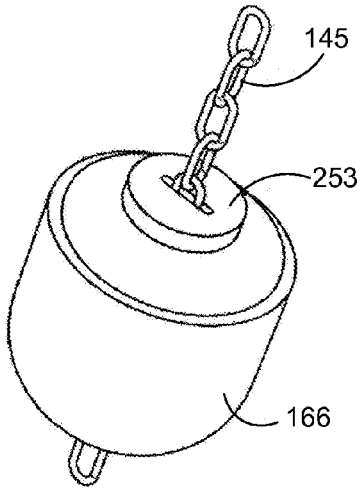
FIGS. 8A and 8B are drawings of another embodiment of the float that may be employed with the toilet flapper of FIG. 1 or the toilet flapper assembly of FIG. 5 according to an embodiment of the present disclosure.
Figure 8B:
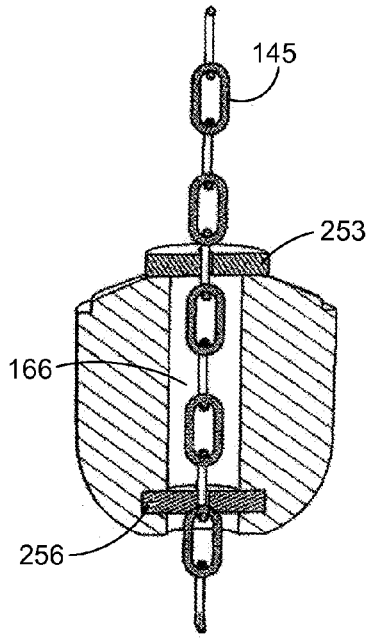

With reference to FIGS. 8A and 8B, shown is a float 163 with a first restriction disk 253 at the top of the float 163 and a second restriction disk 256 near the bottom of the float 163 according to one embodiment. The restriction disks 253 and 256 may be essentially the same as the insert 169. In one embodiment, the restriction disks 253 and 256 may be adhered to the respective portions of the float 163 with an appropriate water resistant adhesive. The restriction disk 256 may be inserted into an internal annular groove as shown. Alternatively, the restriction disk 256 may be adhered directly to the bottom of the float 163.

The tether 145 is threaded through the restriction disks 256 and 253 and through the passageway 166 of the float 163 in a manner similar to that shown with respect to FIG. 5 above. Thus, the restriction disks 253 and 256 provide an alternative means by which the float 163 is positioned along the tether 145. In this respect, the restriction disks 253 and 256 present a restriction associated with the passageway that crimps the tether 145 to hold the float in a predefined position along the tether 145.

With reference to FIGS. 9A, 9B, and 9C, shown is a float 163 with an insert 273 that is inserted into the top of the passageway 166 of the float 163. A retaining member 276 couples to the insert 273 at the bottom of the passageway 166 of the float 163. In one embodiment, the retaining member 276 may include internal threads that are screwed onto a thread at the bottom of the insert 273. Alternatively, the retaining member 276 may be pressed onto the insert 273. Further, the retaining member 276 may be attached to the restriction member 273 using an adhesive or by way of some other attachment as can be appreciated. The insert 273 includes a restriction orifice 279 that crimps the tether 145 to hold the float in the predefined position along the tether 145 in the manner described above.

Figure 10:
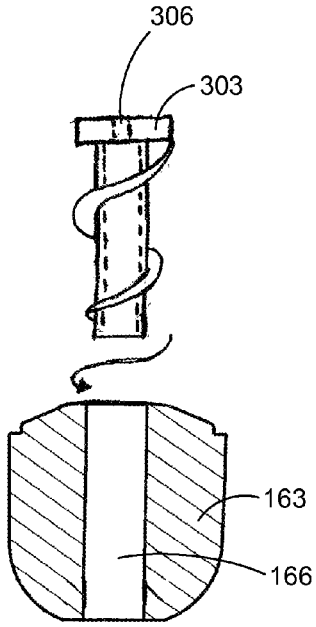
FIG. 10 is a drawing of another embodiment of the float that may be employed with the toilet flapper of FIG. 1 or the toilet flapper assembly of FIG. 5 according to an embodiment of the present disclosure.

With reference to FIG. 10, shown is an exploded view of a float assembly 163 in which a restriction insert 303 comprises a screw that is twisted into the passageway 166 of the float 163. By virtue of the thread of the screw portion of the restriction insert 303, the restriction insert 303 is held into the float 163. The thread of the screw portion may include barbs or other structures that resist rotation of the restriction insert 303 in a reverse direction. The restriction insert 303 includes a restriction orifice 306 that serves to crimp the tether 145 as described above. Note that an adhesive may be placed in the screw portion of the restriction insert 303 to further secure the restriction insert 303 to the inner surface of the passageway 166 of the float 163.

Referring back to FIG. 1, according to another embodiment, a method is provided in which the flapper 136 is employed in a flush cycle. According to various embodiments, the flapper 136 is pulled from the seat 139 of the flush orifice 143 in the toilet tank 103 by virtue of rotation of the flush lever 119 when a user pushes the handle 116. The flapper 136 may be constructed so as not to be buoyant during an entire time the toilet tank 103 drains into a toilet bowl. The flapper 136 is maintained in an open state or tilted upward by virtue of the buoyancy of the float attached to the flapper 136 via the tether 145. Stated another way, the float is disposed on the tether 145 (not shown) as described above. As the toilet tank 103 drains during a flush, the flapper 136 drops down onto the seat 139 of the flush orifice 143 in the toilet tank 103 by virtue of the dropping of the float due to the drop in the water level 113 as water drains from the toilet tank. When the flapper 136 falls onto the seat 139, the flush orifice 143 is sealed shut, thereby allowing the fill valve 106 to refill the toilet tank 103.

By virtue of the fact that the float 163 can be placed in the dome 149 of the flapper 136, then a maximum amount of water can be drained from the toilet tank 103 during a flush. This is due to the fact that the flapper 136 has an increased buoyancy due to the position of the float 163 at lower water levels. At the same time, the float 163 may be advantageously removed from the dome 149 and positioned on the tether 145 by threading the tether 145 through the passageway 166 of the float 163 to allow lesser amounts of water to be released during a flush. The easy adjustability allows the water level in the toilet tank 103 to be fine tuned, therefore more likely an installer will make the proper adjustments in an effort to conserve water. In addition, the flapper 136 and float 163 provide a full range of adjustability and are compatible with toilet tanks 103 of all sizes, including, but not limited to, toilet tank sizes of 1.6, 3.5, 5, and 7 gallon per flush. This is advantageous as currently, on some 1.6 gallon toilets, use of the wrong flapper can change the water consumption from 1.6 to 4.4 gallons per flush.

It should be emphasized that the above-described embodiments of the present invention are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

Therefore, having thus described the invention, at least the following is claimed:

1. An apparatus, comprising:

a flapper having an upper side and a sealing side, the sealing side including a sealing surface;

a dome protruding from the sealing side at a middle of the sealing surface;

an opening of the dome positioned in the upper side of the flapper;

a float removably disposed in the dome of the flapper, wherein the float further comprises a passageway through the float; and a tether attached to a tether connection on a sealing end of the flapper, wherein the tether extends through the passageway, and wherein a restriction associated with the passageway crimps the tether to hold the float in a predefined position along to the tether.

2. The apparatus of claim 1, wherein the sealing surface and the dome are configured to seal a toilet tank drain opening.

3. The apparatus of claim 1, wherein a shape of the float conforms with a shape of the dome.

4. The apparatus of claim 1, further comprising a retaining lip disposed around a periphery of the opening, where the opening is defined by the retaining lip.

5. The apparatus of claim 4, wherein the retaining lip retains the float in the dome.

6. The apparatus of claim 4, where a maximum diameter of the dome is greater than a diameter of the opening defined by the retaining lip.

7. The apparatus of claim 1, where a pulling force can overcome the hold of the restriction crimping the tether to adjust the predefined position of the float along the tether.

8. The apparatus of claim 1, wherein the restriction further comprises an insert disposed in the float.

9. The apparatus of claim 8, wherein the insert further comprises:

a crimping orifice that crimps the tether; and at least one hole for a portion of the float to pass through the at least one hole.

10. The apparatus of claim 8, wherein the insert further comprises:

an upper lip engaging the float;

a lower lip engaging the float; and a crimping slot that crimps the tether.

11. The apparatus of claim 1, wherein the restriction further comprises at least one restriction disk that crimps the tether.

12. The apparatus of claim 1, wherein the restriction further comprises:

an insert; and a retaining member coupled to the insert.

13. The apparatus of claim 1, wherein the restriction further comprises a screw for engaging the restriction with the float.

14. A method, comprising the steps of:

positioning a flapper in a seat of a flush orifice in a toilet tank, the flapper having an upper side and a sealing side, the sealing side having a sealing surface that contacts the seat, the flapper comprising a dome protruding from the sealing side at a middle of the sealing surface and into the flush orifice, the flapper further comprising a float positioned in the dome;

attaching a first end of a tether to a tether connection on a sealing end of the flapper;

removing the float from the dome;

positioning the float on the tether;

attaching a second end of the tether to a flush lever of a toilet tank; and sealing the orifice by virtue of the sealing surface and the dome, where an opening of the dome is positioned in the upper side of the flapper.

15. The method of claim 14, further comprising the step of positioning the float in the dome of the flapper.

16. The method of claim 14, wherein the step of positioning the float on the tether further comprises the steps of:

threading the tether through a passageway through the float; and holding the float at a position along the tether by virtue of a restriction associated with the passageway that crimps the tether.

17. The method of claim 16, further comprising the step of adjusting the position of the float by applying a force to move the float relative to the tether, the force overcoming the hold of the restriction crimping the tether.

* * * * *